United States Patent [19]

Pokorny, Jr. et al.

[11] Patent Number: 4,597,115

[45] Date of Patent: Jul. 1, 1986

[54] LOW SEATING LEVEL SOFA-BED MECHANISM

[75] Inventors: Louis Pokorny, Jr., Ronkonkoma; L. Robert Pokorny, Wading River, both of N.Y.

[73] Assignee: Louis Pokorny Company, Inc., Ronkonkoma, N.Y.

[21] Appl. No.: 463,842

[22] Filed: Feb. 4, 1983

[51] Int. Cl.[4] ..... A47C 17/14

[52] U.S. Cl. ..... 5/13; 5/29

[58] Field of Search ..... 5/13, 29, 45 B, 14, 5/28, 51 G, 51 J, 51 K

[56] References Cited

U.S. PATENT DOCUMENTS

| | | | |
|---|---|---|---|
| 2,505,989 | 5/1950 | Pokorny et al. | 5/13 |
| 2,722,016 | 11/1955 | Pokorny, Jr. | 5/13 |
| 2,724,126 | 11/1955 | Thomas | 5/13 |
| 2,818,583 | 1/1958 | Nowell et al. | 5/13 |
| 2,832,965 | 5/1958 | Pokorny, Jr. | 5/13 |
| 2,972,753 | 2/1961 | Thomas | 5/13 |
| 3,178,731 | 4/1965 | Pokorny, Jr. | 5/13 |
| 3,239,851 | 3/1966 | Barabas et al. | 5/13 |
| 3,284,814 | 11/1966 | Mikos | 5/13 |
| 3,292,188 | 12/1966 | Gerth | 5/13 |
| 3,321,777 | 5/1967 | Pokorny, Jr. | 5/13 |
| 3,345,651 | 10/1967 | Fox | 5/13 |
| 3,416,168 | 12/1968 | Pokorny, Jr. | 5/29 |
| 3,508,283 | 4/1970 | Dukellis et al. | 5/13 |
| 3,525,106 | 8/1970 | Perry | 5/13 |
| 3,636,572 | 1/1972 | Eakins | 5/13 |
| 3,657,747 | 4/1972 | Rogers, Jr. et al. | 5/29 |
| 4,200,941 | 5/1980 | Gill et al. | 5/13 |

*Primary Examiner*—Gary L. Smith
*Assistant Examiner*—Vinh Luong
*Attorney, Agent, or Firm*—Alan H. Levine

[57] ABSTRACT

A sofa-bed mechanism for use in a sofa body having a relatively low seating level. The mechanism includes four sections foldable within the sofa body and alternatively extensible out of the sofa body to define a bed. The linkage which connects the four sections to the sofa body, and controls movement of those sections, includes an arrangement for permitting the mechanism to be located at a low level within the sofa body, and the lower rear corner of the mechanism to swing through a shallower arc than usual. The linkage also includes an arrangement for preventing the top section from experiencing opening movement, and for preventing the rear supporting leg of the mechanism from opening, until the sections move out from beneath the sofa body breast rail and the rear leg passes over the sofa body front rail. In one embodiment, the usual spring for aiding opening and closing movement of the mechanism is attached to movable pivots at both of its ends to increase the torque applied to the mechanism during its opening and closing movements.

5 Claims, 10 Drawing Figures

10
12
11
66
62
57
61
54
53
49
14
46
51
27
55
47
33
125
152
122
112
155
24
73
110
130
114
74
142
71
45
44
34
65
70
32
35
96
104
10
55
67
20
80
109
107
18
22
85
90
92
83

55
55a
62
61
51
32
54
47
57
53
46
44

10
11
62
12
57
27
67
61
14
54
49
46
55
51
62
55
33
24
47
53
44
32
70
45
71
16
34
67
20
67
18
22

LOW SEATING LEVEL SOFA-BED MECHANISM

This invention relates to sofa beds, and more particularly to an improved sofa-bed mechanism linkage permitting the accommodation of a collapsed mechanism in a relatively low seating level sofa body.

A variety of sofa-bed mechanisms have previously been evolved, such for example as shown in U.S. Pat. Nos. 3,416,168 and 3,321,777, in which a four-section pivotally interconnected mechanism is provided for supporting a mattress in combination with a sofa body. The mechanism comprises four sections, which in the collapsed position may be described as a rear relatively vertical section pivotally interconnected at its lower end to a horizontally extending lower section. This horizontally extending lower section is pivotally connected at the other end to a vertically extending front section which is, in turn, pivotally connected to a horizontally extending upper section. These sections, as is known, are dimensioned so that in collapsed condition, they lie within the framework of a sofa, and when extended, provide a support for the mattress.

These prior art structures, though eminently suitable in selectively supporting a mattress in distended bed condition, or collapsed sofa condition, are limited in their applicability to relatively bulky sofas, with relatively high seat levels, such as is necessary to accommodate the mechanism and mattress. Modern furniture styling dictates the use of a relatively low seating level, preferably with a relatively narrow distance between the bottom of the sofa and the top of the sofa cushion. In attempting to accommodate these prior art sofa bed mechanisms, such a low seating level sofa has in some cases caused the use of a relatively thin mattress, thus reducing the comfort of the bed.

It is with the above considerations in mind that the present improved sofa-bed mechanism has been evolved, serving to provide a mattress supporting arrangement which may be combined with a sofa body of desired low seating level, while at the same time accommodating a relatively thick mattress of approximately 4 inches.

This is accomplished, in accordance with the present invention, by providing a sofa-bed mechanism, adapted for securement to a sofa body, in which the mechanism is formed with four sections which in collapsed condition enclose in a quadralateral enclosure a mattress which is folded by the collapse of the mechanism and which, when the mechanism is extended, serves to support the mattress in desired bed orientation. A main control link is connected to the pivot between the rear section and the lower section, and that link is caused to swing about a movable pivot so as to control the movement of the sections in such a way that they readily pass beneath the breast rail of the sofa body and over the front board of the sofa body.

Additionally, according to the invention, an auxiliary bell crank has been added between an elevator arm, which helps to lift the four sections out of the sofa body, and the linkage controling the unfolding of a rear leg which supports the central portion of the extended mechanism. The auxiliary bell crank serves to retard the unfolding movement of the rear leg until it passes over the sofa body front board, and at the same time retards the unfolding movement of the upper horizontal section away from the lower horizontal section until the upper horizontal section has passed beneath the breast rail of the sofa body.

Moreover, another feature of the invention relates to the tension spring conventionally provided to bias the elevator arm in a direction tending to lift the mechanism out of the sofa body, during opening of the bed, and tending to lift the mechanism upwardly from the floor, upon closing the bed. The end of the spring opposite the elevator arm is, according to the invention, attached to a movable pivot, having the effect of increasing the torque applied to the elevator arm by the spring.

Additional objects and advantages of the invention will be apparent from the following description in which reference is made to the accompanying drawings. In the drawings.

Figure 1:
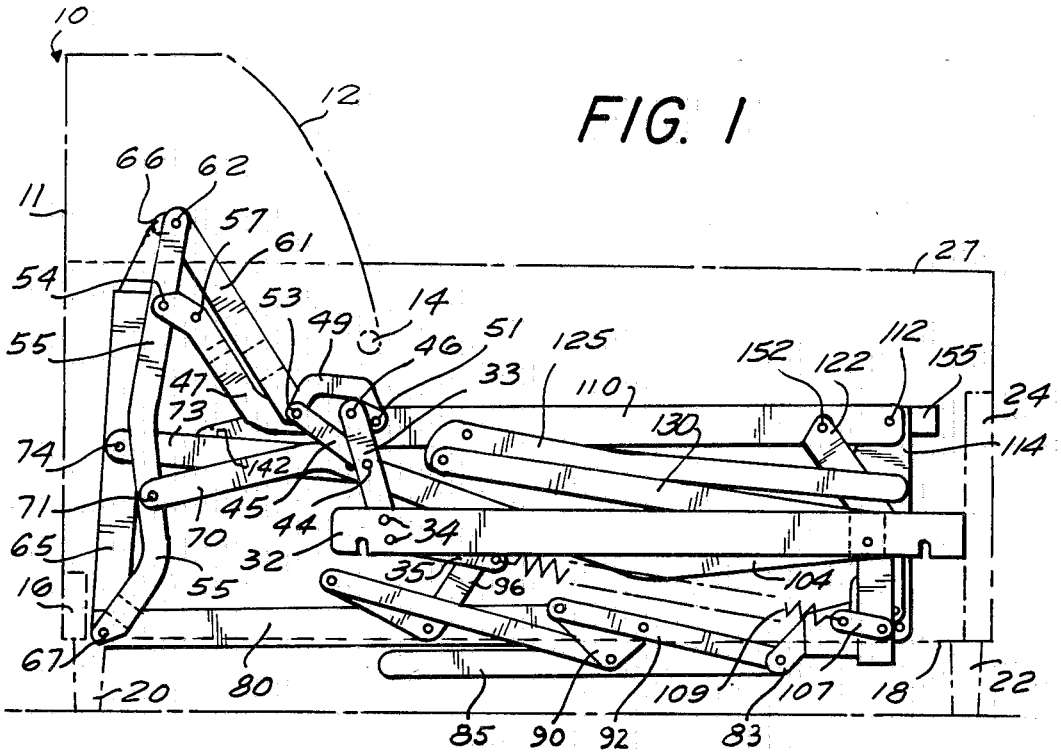
FIG. 1 is a side elevational view of a sofa-bed mechanism, according to the invention, in collapsed condition within a sofa body.

Referring now to the drawings, a sofa body 10, as illustratively shown in phantom, is formed with a currently stylish low seating level, having a back wall 11, and upholstered back 12, the bottom of which is defined by a breast rail 14. Rear frame rail 16 (FIGS. 1 and 2) defines the lower rear end of the sofa, which is formed as conventionally, with bottom 18, rear legs 20, front legs 22, and front board 24.

The sofa bed mechanism, as shown in collapsed or retracted position in FIG. 1, is formed such that in its collapsed condition, it is retained between the rear frame rail 16 and front board 24, and is of a height usually less than that of the height of the top of front board 24, as best seen in FIG. 1.

The above described sofa body components are as usual formed with the rear frame rail 16 and front board 24 extending between opposed sofa sidewalls, one of which is shown in phantom at 27, upholstered to form the arms of the sofa.

The sofa-bed mechanism is joined to the sofa body by means of a pair of main mounting brackets 32 (FIGS. 2 and 4–6), one of which is shown, which are fixed to the sofa body at the sides 27 thereof. Bracket bar 33 extends up from the rear of the mounting bracket 32, and is fixed to the main mounting bracket 32 by means of rivet pins 34, or like fastening elements.

The sofa-bed mechanism includes four sections pivoted to one another in succession, so as to provide for both folding and linear extension of the sections. In the fully folded or collapsed condition, the sections assume the relative positions shown in full lines in FIG. 1. It will be understood that these sections extend transverse to the plane of the drawings across substantially the full length of the sofa, from one side 27 to the other, and that the pivotally connected links (to be described) are provided in duplicate, one at each side.

The terms "rear section", "bottom section", "front section" and "top section" refer to the sections as viewed in FIG. 1, in which the sections are shown in collapsed condition. As viewed in elevation, the sections have a relatively rectangular orientation and comprise rear section 65, pivotally connected to lower section 80, which is in turn pivotally connected to front section 114, which is in turn pivotally connected to top section 110.

Figure 7:
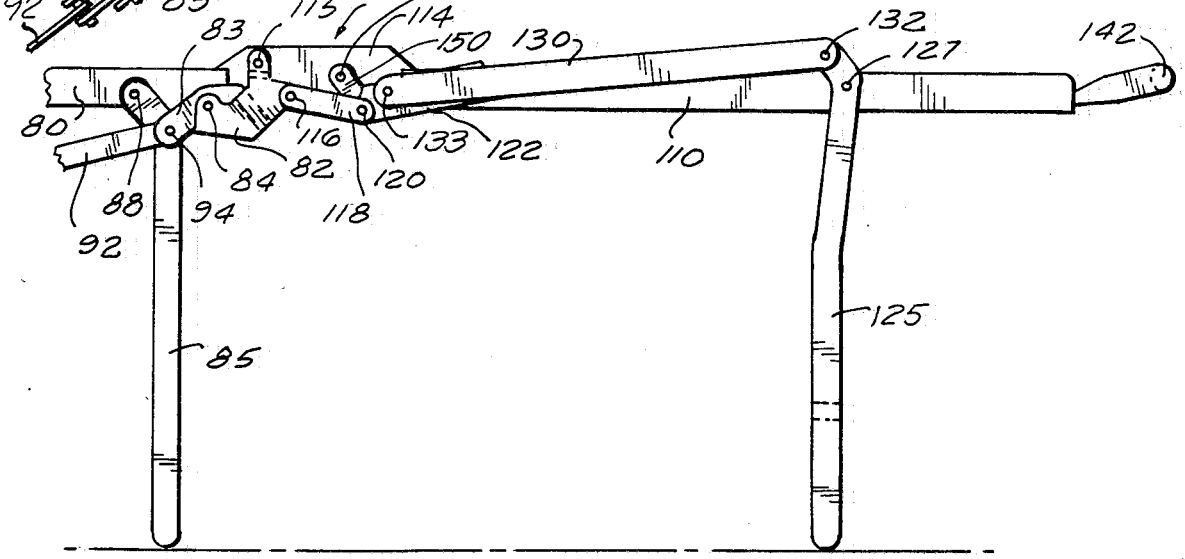
FIG. 7 is a fragmentary side elevational view of the mechanism showing the front and upper sections unfolded in a horizontal bed-defining condition.
Figure 6:
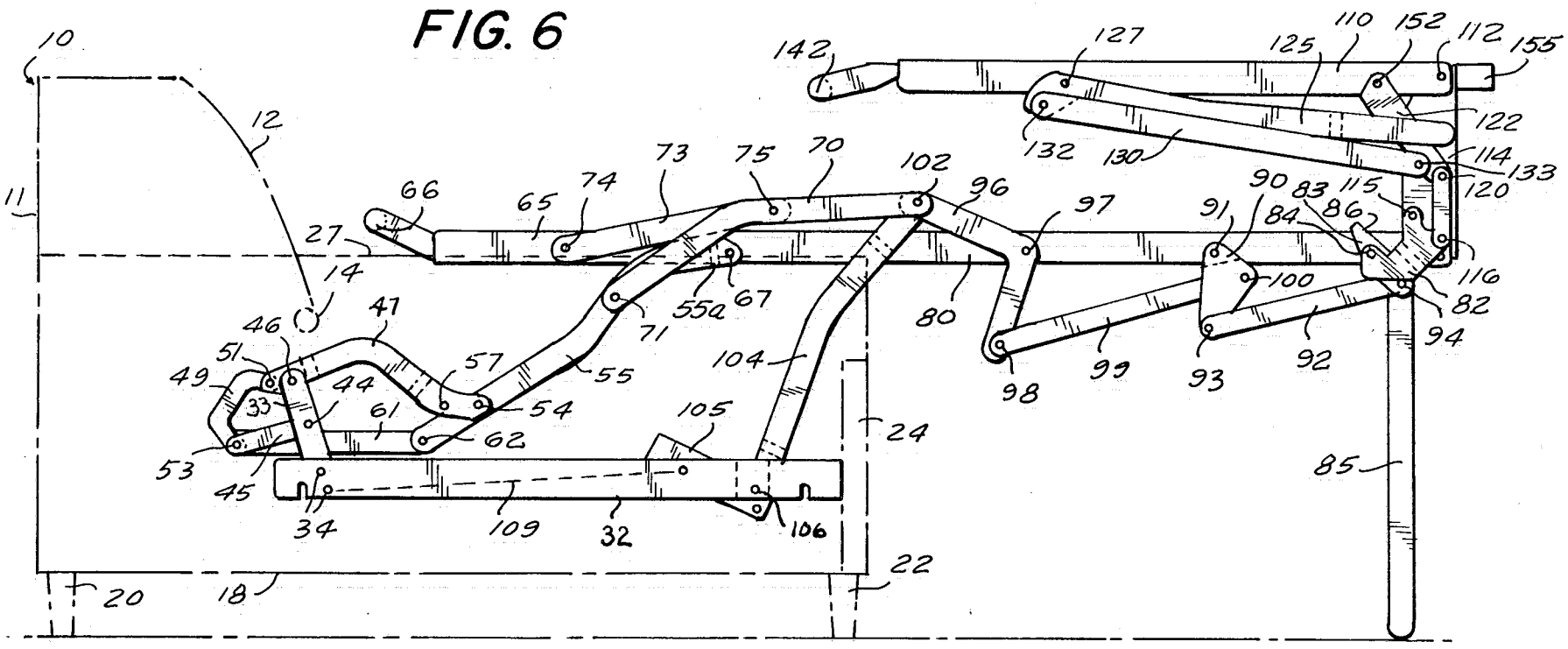
FIG. 6 is a view similar to FIG. 1 showing the rear and lower sections of the sofa-bed mechanism unfolded out of the sofa body, the front a upper sections still being folded.

The four pivotally interconnected sections 65, 80, 114, and 110, shown in FIG. 1, are intended for extension from the position shown in FIG. 1 to the position shown in FIGS. 6 and 7, wherein the extended mechanism can support a mattress at a comfortable height above the floor.

As seen most clearly in FIG. 6, the four pivotally connected sections are pivotally supported in the sofa body by a main control link 55 and an elevator arm 104. The elevator arm is pivotally mounted, at 106, on bracket 32. A dog leg 105, fixed to elevator arm 104, has a plate 107 pivoted to it, one end of a tension spring 109 being connected to the plate. The other end of the spring is connected to a plate 35 (FIG. 1) pivotally carried by one of the rivets 34.

Main control link 55 is pivotally connected at one end to the pivot connection 67 between rear section 65 and lower horizontal section 80. At its other end, control link 55 is pivoted to two subsidiary control links. Specifically it is pivoted at 62 to an upper rear control link 61, and near that other end, control lihk 55 is pivoted at 54 to a lower rear control link 47. (The terms "upper" and "lower" rear links are derived from the relative positions of these links in the fully collapsed condition of the sofa-bed mechanism shown in FIG. 1.)

With continued reference to FIG. 6, near its opposite end, lower rear control link 47 is pivoted to bracket bar 33 at 46. Pivoted to the end of link 47, at 51, is one end of a coupling link 49, the other end of which is pivoted, at 53, to one end of a pivot link 45. The other end of link 45 is pivoted to bracket bar 33 at 44. Also connected to pivot 53 is the end of upper rear control link 61 opposite the end pivoted to main control link 55 at 62. Lower rear control link 47 is provided with a stop pin 57 which, as seen in FIG. 6, limits the relative movement between link 47 and main control link 55 to their desired extended condition shown in that figure. Rear section 65 is provided with a head rail 66 against which the head end of a mattress abuts.

Main link 70 is pivotally connected at one of its ends, by pivot 102, to the end of elevator arm 104 opposite the end pivoted to bracket 32. The other end of the main link is pivoted at 71 to main control link 55 at a point between the ends of the latter. A rear section support link 73 is pivoted between a point 75, intermediate the ends of main link 70, and a point 74 on rear section 65.

The end of lower horizontal section 80, opposite its connection at 67 to rear section 65, is provided with a connection plate 82, pivotally connected to a lock link 83 by pivot 84.

Rear leg 85, as best seen in FIG. 7, is pivotally connected to section 80 by pivot pin 88. An auxiliary bell crank 90 (FIG. 6) is pivotally secured to lower section 80 by pivot pin 91 and to a rear leg control link 92 by pivot pin 93. Rear leg control link 92 is pivotally coupled at its other end to leg 85 by pivot pin 94 (see FIGS. 6 and 7).

A main bell crank 96 is pivoted by pin 97, as best seen in FIG. 6, to lower section 80 rearwardly of auxiliary bell crank 90, and the free end of one leg of bell crank 96 is pivoted by pin 98 to bell crank connecting link 99, which is coupled by pivot pin 100 to auxiliary bell crank 90. The free end of the other leg of bell crank 96 is pivoted by pin 102 to the ends of main link 70 and elevator arm 104.

As best seen in FIGS. 1, 4, 5 and 6, upper horizontal section 110 is pivoted at 112 to front section 114. Connecting plate 82 is pivoted to front section 114 at 115, and link 118 is pivoted at one end to connecting plate 82 at 116. At its other end, link 118 is connected, by pivot 120, to support link 122 and to one end of link 150 (FIG. 7). The other end of link 122 is pivoted to upper section 110 at 152, and the other end of link 150 is pivoted to front section 114 at 151.

Figure 4:
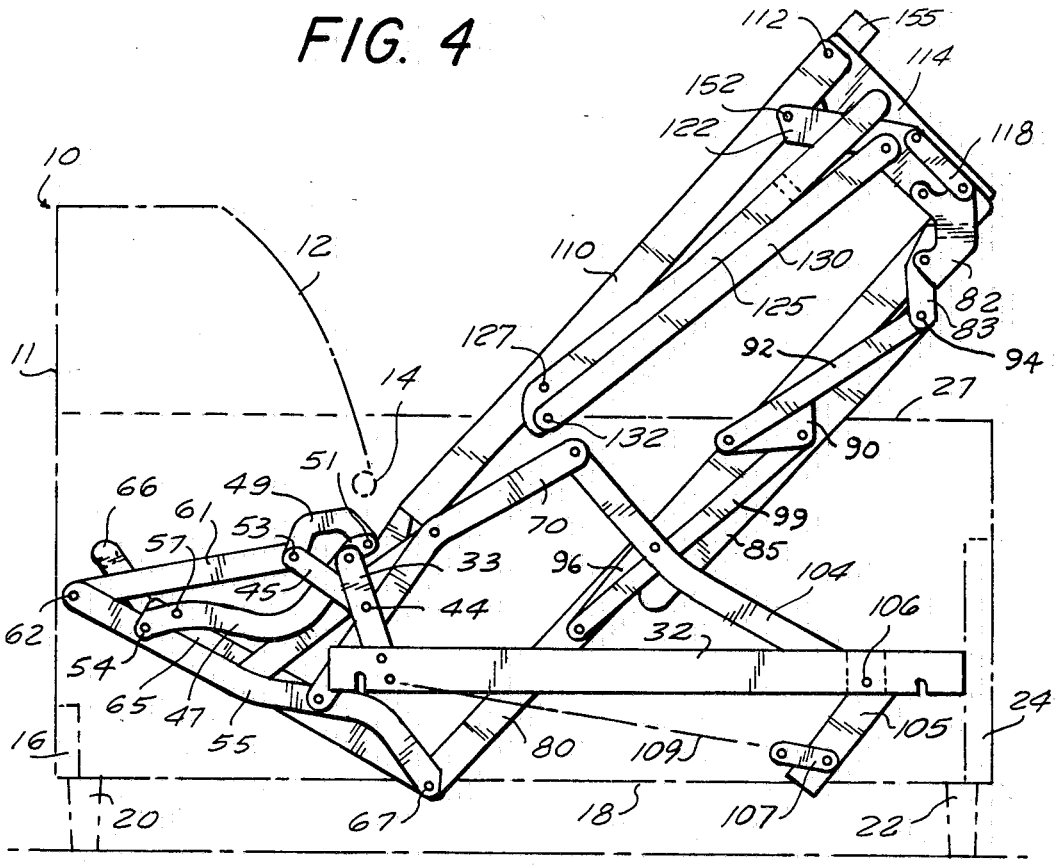
FIG. 4 is a view similar to FIG. 1 showing the mechanism moved partially out of the sofa body.
Figure 8:
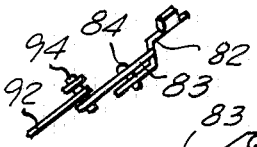
FIG. 8 is a fragmentary top view of the links shown at the left side of FIG. 7.

A lock link 83 (FIGS. 4, 5, 6 and 8), pivoted at 94 to one end of rear leg control link 92 and also to leg 85, has a surface 86 adapted to engage an an edge of connection plate 82 during the movement of the mechanism between the positions of FIGS. 1 and 4. Lock link 83 is also pivoted to connecting plate 82 at 84. Rear leg 85 is connected to lower section 80 by pivot 88.

Front leg 125, as best seen in FIG. 7, is pivoted to upper horizontal section 110 by pin 127, and to front leg control link 130 by pin 132. Front leg control link 130 is pivoted by pin 133 to the support link 122. Foot rail 142 is formed at the end of front mattress supporting linkage 110 to retain the mattress in position.

The above-described collapsable sofa-bed mechanism components are fabricated preferably of metal, utilizing conventional stamping, bending, and other metal forming techniques and assembled with the described pivot connections, usually formed by rivets. The various sections and linkages shown represent a side elevational view of the mechanism on one side of the sofa body, with a corresponding set of links on the other side. The side rails of the mattress supporting sections 65, 80, 114 and 110 are connected by cross members, as conventional in sofa beds, as for example, are shown in FIG. 6 of U.S. Pat. No. 3,984,883.

In conventional fashion, a foldable mattress is positioned on the mattress supporting sections 65, 80, 114, and 110 when in extended position. The mechanism is then collapsed to the position shown in FIG. 1 in which section 110 overlies the mattress, providing a support for the conventional sofa cushions which are employed when the mechanism is collapsed to the sofa forming position shown in FIG. 1.

Thereafter, when it is desired to convert the sofa to a bed, the sofa cushions are removed, and the crossbar 155 (or a handle attached thereto) carried by section 114 is gripped to lift the mechanism to the position shown in FIG. 4. During this movement, it will be observed, by comparing FIGS. 1 and 4, that pivot link 45 and coupling link 49 remain relatively stationary, with all other links pivoting about the pivots 51 and 53 at the ends of coupling link 49. As the mechanism moves to the position of FIG. 5, pivot 53 moves downwardly, and this downward movement continues as the mechanism moves to the position of FIG. 6. This pivoting action moves main control link 55 along the path shown by the dotted lines in FIG. 2, as the mechanism moves through and to the positions shown sequentially in FIGS. 4, 5, and 6, at which time, mattress supporting sections 65 and 80 will be in their bed orientation as seen in FIG. 6, supported by rear leg 85. Thereafter, foot rail 142 is gripped and upper mattress supporting section 110 and front section 114 are opened to the bed position shown in FIG. 7, supported by front leg 125.

The linkage described permits the sofa-bed mechanism of this invention to be accommodated within a sofa body having a relatively low seating level. What this means is that the sofa body breast rail 14 is closer to the floor than in a sofa body having a standard height seating level, and the sofa-bed mechanism is closer to the floor when in folded condition, within the sofa body (FIG. 1). Because the bottom of the mechanism is closer to the floor, the problem presented was how to swing pivot connection 67, at the joint between the rear section 65 and lower section 80, out of the sofa body without that pivot connection striking the floor. This is accomplished by providing a movable pivot 53 for the upper rear control link 61, which is connected between pivot 53 and the pivot 62 at the upper end (in FIG. 1) of main control link 55. The lower end of the main control link is, of course, pivoted at 67 to the sections 65 and 80. Since pivot 53 remains substantially stationary, at a relatively high position, during the initial movement of the mechanism, from the position of FIG. 1 to that of FIG. 4, after which pivot 53 drops, the arc of movement of pivot 67 is flattened between FIG. 1 and FIG. 4 (see FIG. 2). This flattened arcuate path permits pivot 67 to start at a relatively low point and yet not touch the floor as the mechanism swings out of the sofa body.

Figure 3:
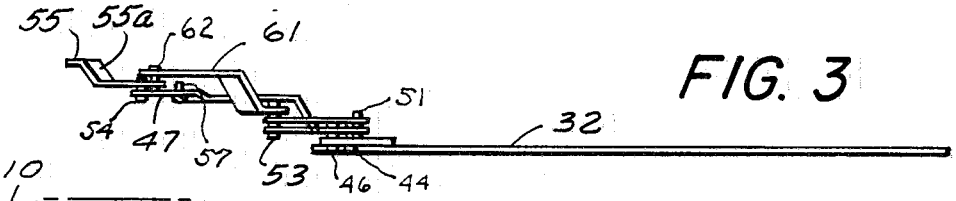
FIG. 3 is a top view of the linkage shown in full lines in FIG. 2.
Figure 2:
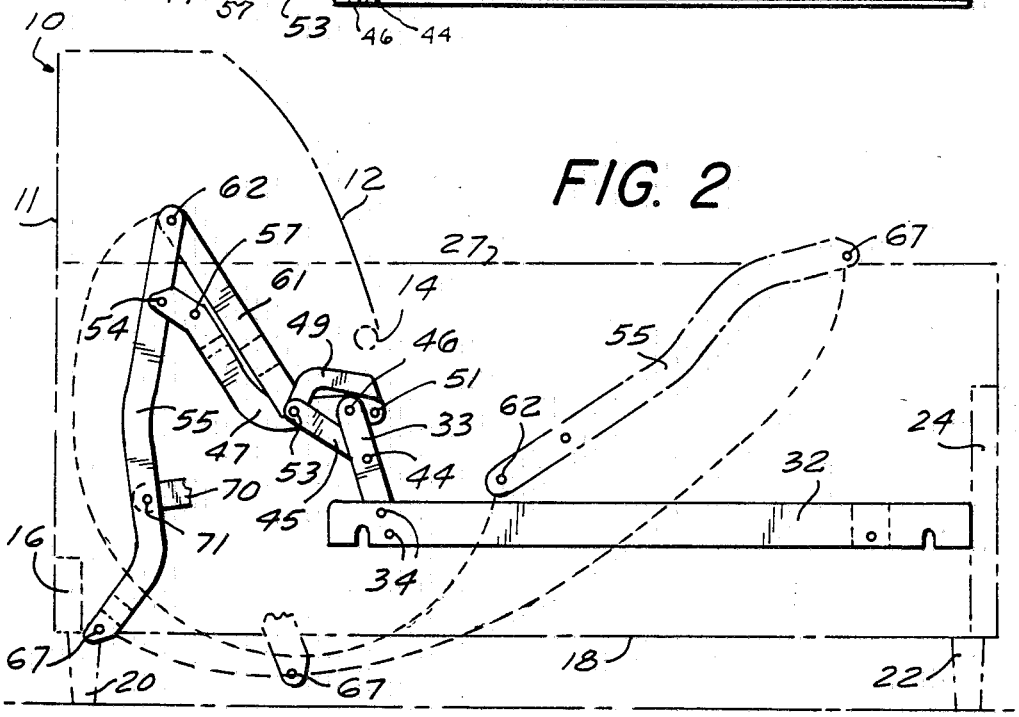
FIG. 2 is an elevational view of a portion of the sofa-bed mechanism, showing the path of movement of the control link as the mechanism moves between its closed and open conditions.

In moving from the FIG. 1 to the FIG. 4 position, it will be observed that spring 109 pulls on leg 105 of elevator link 104 to move main link 70, which in turn pulls control link 55 along the dotted line path of FIG. 2 until stop pin 57 on link 47 hits control link 55, as seen in FIG. 6. The offset **55*a* (FIG. 3) on control link 55 adjacent pivot 67 is abutted by link 73 to support section 35 in the open position shown in FIG. 6**.

The locking offsets on the various links, as shown on the drawings, similarly limit movement of the links at the desired limit of their travel to insure desired rigidity of mattress support in the extended position of the mechanism. Coupling link 49 limits the movement of pivot link 45, which carries pivot 53, to a path behind the sofa breast rail 14 and through an arc of less than 90°, as will be noted by comparing the position of link 45 in FIG. 1 with the position of link 45 in FIG. 6. When the sofa-bed mechanism is moved from a collapsed to an extended position, pivot link 45 moves downwardly, lowering the control link 61 rotation axis, thus permitting the rear of the mechanism to readily clear the relatively low breast rail.

Another feature of the invention involves introducing the auxiliary bell crank 90 between links 99 and 92, the latter being pivoted to rear leg 85 and to the lock link 83. As the mechanism moves from the position of FIG. 1 to the position of FIG. 5, the main bell crank 96 pivots through an angle of about 62°, so that its lower arm in FIG. 1 moves from the orientation shown by the upper broken lines in FIG. 5 to the solid line orientation in FIG. 5, the angle of movement being identified by the curved double-headed arrow "A". However, due to the presence of auxiliary bell crank 90 and connecting links 99 and 92, rear leg 85 and lock link 83 rotate through only about 8°, while the mechanism moves from its FIG. 1 to its FIG. 5 position. As a result, leg 85 remains almost completely tucked in toward the lower section 80, so that its lower end remains raised well above the top of front board 24 of the sofa body as it passes over the front board (see FIG. 5). At the same time, engagement of surface 86 of lock link 83 against on edge of connecting plate 82 prevents upper section 110 from pivoting away from lower section 80, due to the outward pressure of the mattress, thereby assuring that the upper section moves well beneath breast rail 14 as the mechanism swings out of the sofa body (FIG. 4).

Figure 5:
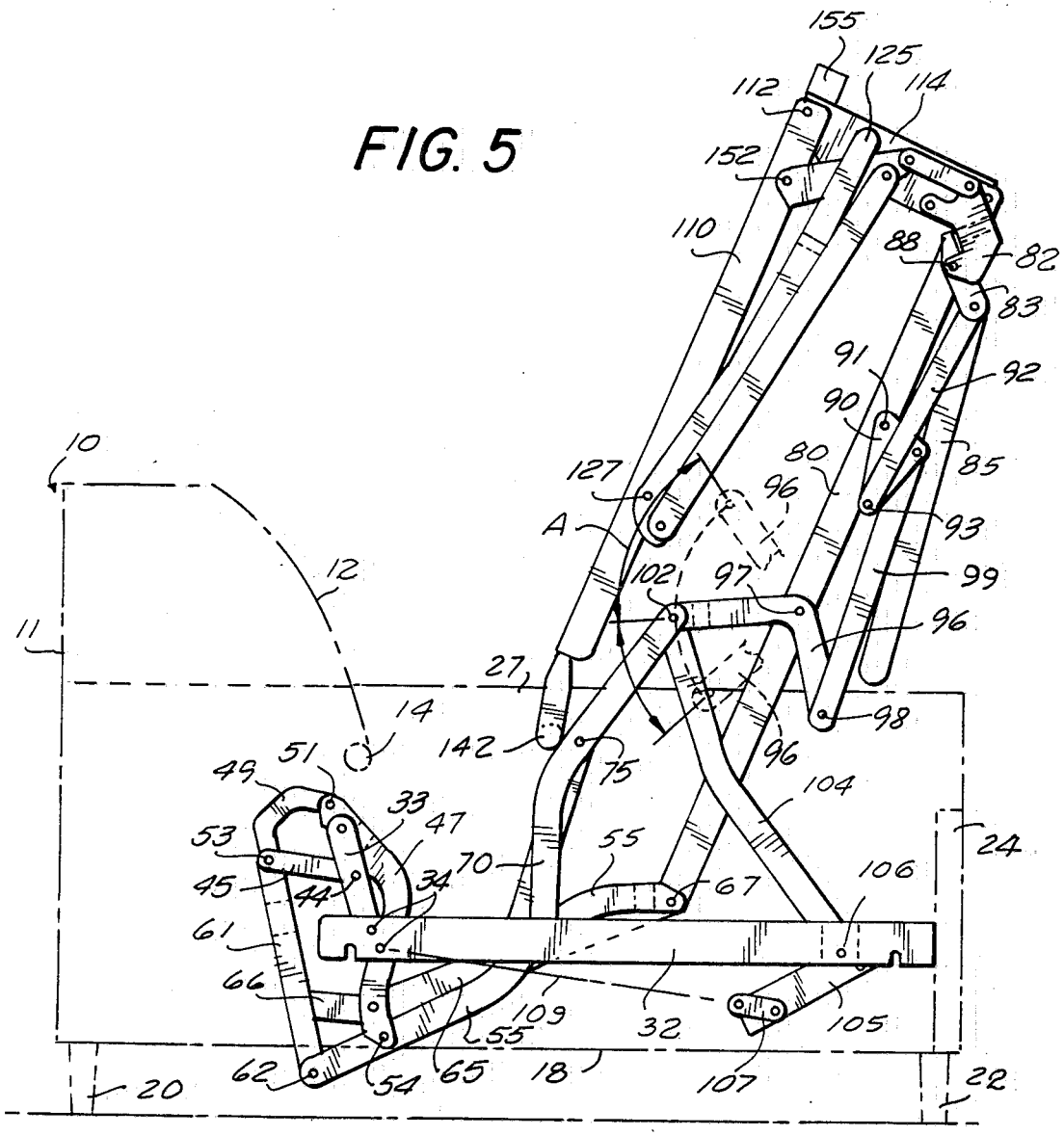
FIG. 5 is another view similar to FIG. 1 showing the mechanism moved farther out of the sofa body.

As the mechanism moves from its FIG. 5 position to its FIG. 6 position, main bell crank 96 pivots through an angle of about 38°, as indicated by the double headed arrow "B" in FIG. 5. However, during the same period, rear leg 85 and lock link 83 rotate through an angle of about 82°. Thus, it will be seen that the presence of auxiliary bell crank 90 causes the opening movement of rear leg 85 and upper section 110 to be retarded until the mechanism moves outwardly past breast rail 14 and front board 24, after which the leg and upper section open very rapidly.

Figure 9:
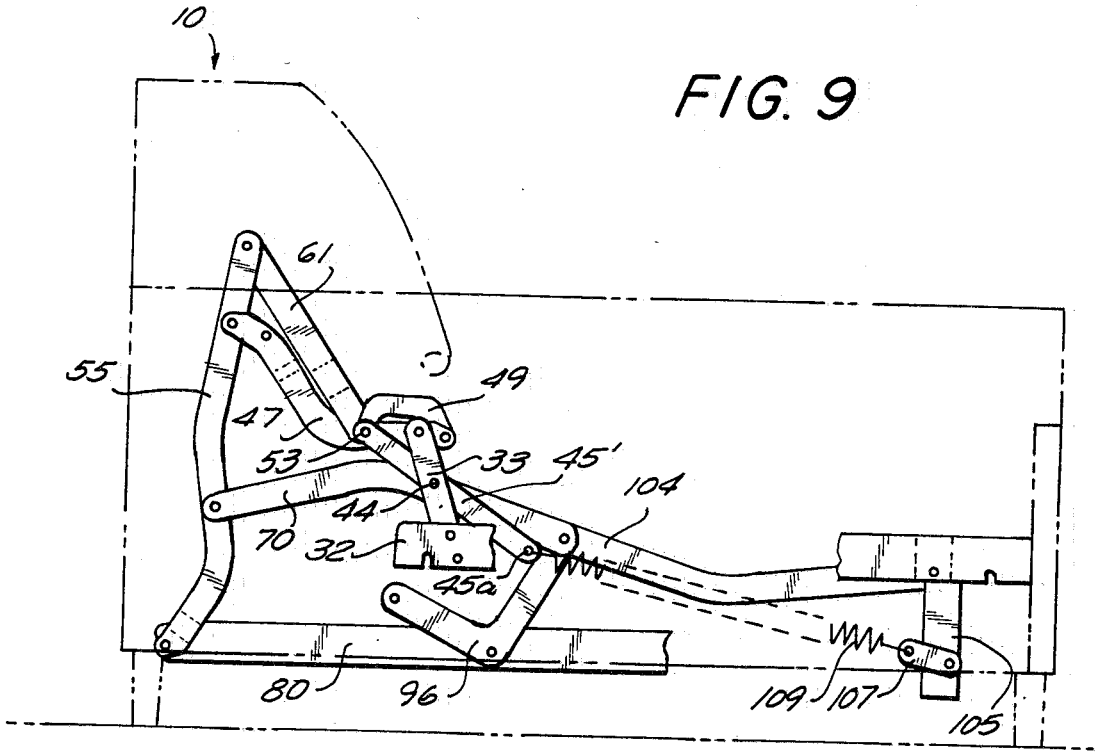
FIG. 9 is a side elevational view of a portion of the sofa-bed mechanism in collapsed condition within a sofa body, showing an alternative connection for the tension spring which biases the elevator arm.
Figure 10:
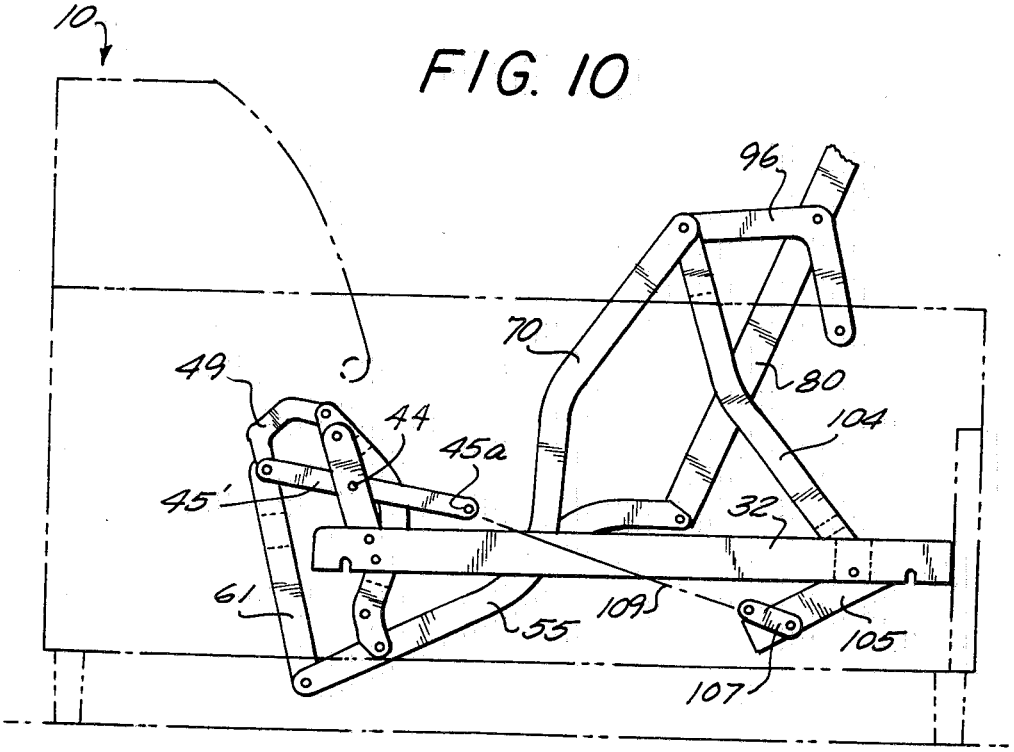
FIG. 10 is a view similar to FIG. 9 showing the alternative spring connection when the parts are in a condition corresponding to that of FIG. 5.

The embodiment of the invention illustrated in FIGS. 9 and 10 offers an additional advantage. The parts illustrated in these figures, and their relative orientations are, with one exception, identical to the parts shown in FIGS. 1 and 5, respectively. Therefore, all but one of the parts bear the same reference numerals as in the previous figures. The one difference is that pivot link 45 has been lengthened so that the corresponding pivot link 45' of FIGS. 9 and 10 extends in both directions from pivot 44. Tension spring 109, instead of being connected at its left end (as viewed in the drawings) to a link 35 mounted on fixed bracket 32, is connected to the end **45*a* of pivot link 45'. Thus, spring 109 is connected, at its end opposite by 105, to a movable pivot point 45*a*. Furthermore, as shown in FIG. 10, since link 45' moves out of alignment with the axis extending between pivot 44 and plate 107, spring 109 is stressed more than it would be if its left end were connected to a fixed point. Consequently, an increased torque is applied to leg 105, and hence to elevator arm 104, by spring 109**, thereby aiding in lifting the mechanism out of the sofa body.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. In a sofa-bed mechanism having a relatively stationary bracket and in which bed sections are pivoted to one another in succession and include a rear section and a lower horizontal section, and a linkage system causes the sections to move a predetermined path between a folded condition and an extended condition: the linkage system including a main control link pivotally connected to said rear and lower horizontal sections, a first subsidiary control link pivoted to the main control link, a second subsidiary control link pivoted to the bracket and to the main control link, and a pivot link pivotally mounted on the bracket and defining the pivot axis for the first subsidiary control link, the pivot link moving to shift the pivot axis of the first subsidiary control link as the bed sections move from their folded condition to their extended condition.

2. A sofa-bed mechanism as defined in claim 1 including a coupling link pivotally interconnecting the second subsidiary control link and the pivot link, whereby movement of the second subsidiary control link causes movement of the pivot link and hence movement of the pivot axis of the first-mentioned subsidiary control link.

3. A sofa-bed mechanism as defined in claim 1 wherein one end of the main control link is connected to the pivot joint between the rear section and the lower horizontal section, the other end of the main control link is connected to one end of the subsidiary control link, and the other end of the subsidiary control link is connected to one end of the pivot link.

4. A sofa-bed mechanism as defined in claim 1 wherein the pivot link rotates through an angle of less than 90° as the bed sections move from their fully folded position to their fully extended position.

5. A sofa-bed mechanism as defined in claim 1 wherein the pivot link rotates to lower the pivot axis of the subsidiary control link after the bed sections have moved part of the way from their fully folded position to their fully extended position.

* * * * *